US008839987B2

(12) United States Patent
Doglioni Majer

(10) Patent No.: US 8,839,987 B2
(45) Date of Patent: Sep. 23, 2014

(54) AUTOMATIC VENDING MACHINE AND PROCESS FOR DISPENSING BEVERAGES

(75) Inventor: Aldo Doglioni Majer, Milan (IT)

(73) Assignee: Rheavendors Services S.p.A., Caronno Pertusella (VA) (IT)

( * ) Notice: Subject to any disclaimer, the term of this patent is extended or adjusted under 35 U.S.C. 154(b) by 0 days.

(21) Appl. No.: 13/583,656

(22) PCT Filed: Mar. 9, 2011

(86) PCT No.: PCT/IB2011/000503

§ 371 (c)(1),
(2), (4) Date: Oct. 14, 2012

(87) PCT Pub. No.: WO2011/110928

PCT Pub. Date: Sep. 15, 2011

(65) Prior Publication Data

US 2013/0025742 A1 Jan. 31, 2013

(30) Foreign Application Priority Data

Mar. 11, 2010 (EP) ..... 10425065

(51) Int. Cl.

| | |
|---|---|
| ***G07F 11/00*** | (2006.01) |
| ***B67D 7/78*** | (2010.01) |
| ***B65B 43/42*** | (2006.01) |
| ***G07F 13/10*** | (2006.01) |
| ***G07F 11/54*** | (2006.01) |

(52) U.S. Cl.

CPC ..... *G07F 11/54* (2013.01); *G07F 13/10* (2013.01)

USPC ..... 221/96; 141/168; 141/174; 222/143; 222/144

(58) Field of Classification Search

CPC ..... G07F 13/10

USPC ..... 141/174; 221/96; 222/143, 144

See application file for complete search history.

(56) References Cited

U.S. PATENT DOCUMENTS

| | | | | | |
|---|---|---|---|---|---|
| 2,591,507 | A | * | 4/1952 | Brous | 141/174 |
| 2,682,984 | A | * | 7/1954 | McLikian et al. | 221/96 |
| 2,726,026 | A | * | 12/1955 | Gould et al. | 141/104 |
| 3,283,951 | A | * | 11/1966 | Gladfelder | 221/11 |
| 3,618,642 | A | * | 11/1971 | Beaulieu | 141/1 |
| 4,632,274 | A | * | 12/1986 | Garbe | 221/96 |
| 4,807,780 | A | * | 2/1989 | Parsons et al. | 221/113 |
| 4,934,257 | A | * | 6/1990 | Mikkelsen | 99/279 |
| 4,989,753 | A | * | 2/1991 | Brogna et al. | 221/121 |
| 5,000,345 | A | * | 3/1991 | Brogna et al. | 221/5 |

(Continued)

FOREIGN PATENT DOCUMENTS

| | | | |
|---|---|---|---|
| DE | 4203088 | A1 | 10/1992 |
| EP | 0303881 | A1 | 2/1989 |

(Continued)

*Primary Examiner* — Timothy L Maust

(74) *Attorney, Agent, or Firm* — Lonnie R. Drayer

(57) ABSTRACT

An automatic machine for dispensing beverages has at least two rotatable cup dispensing towers having a plurality of housings for variously sized stacked cups. The housings may be rotated in a selective manner. Cups are dispensed from the housings. A cup holder device includes cup holders that receive the dispensed cups. The cup holder device is rotatable about a vertical axis that is parallel to the axes of rotation of the rotatable cup dispensing towers. The cup holder device is provided with at least two cup holders that move along concentric circular trajectories with respect to the vertical axis of the cup holder device.

16 Claims, 5 Drawing Sheets

(56) References Cited

U.S. PATENT DOCUMENTS

| | | | | | |
|---|---|---|---|---|---|
| 5,172,828 | A | * | 12/1992 | Ficken et al. | 221/11 |
| 5,400,838 | A | * | 3/1995 | Schjerven et al. | 141/174 |
| 6,053,359 | A | * | 4/2000 | Goulet et al. | 221/221 |
| 6,102,246 | A | * | 8/2000 | Goulet et al. | 221/11 |
| 6,688,460 | B2 | * | 2/2004 | Kim | 198/750.1 |
| 7,325,700 | B1 | * | 2/2008 | Masten et al. | 221/265 |

FOREIGN PATENT DOCUMENTS

| | | | |
|---|---|---|---|
| EP | 1207131 | A1 | 12/2002 |
| EP | 1818881 | A1 | 8/2007 |
| GB | 1604306 | A | 12/1981 |
| GB | 2254319 | A | 10/1992 |
| IT | PN1994A000068 | A | 5/1996 |
| IT | PN940068 | A1 | 9/1996 |

* cited by examiner

AUTOMATIC VENDING MACHINE AND PROCESS FOR DISPENSING BEVERAGES

FIELD OF THE INVENTION

The present invention relates generally to an automatic dispensing machine for beverages, and more particularly to an automatic machine for dispensing coffee and other beverages in cups of various sizes according to a user's choice.

BACKGROUND OF THE INVENTION

Prior art automatic dispensing machines are most often designed to provide the user with only a single-sized cup regardless of the type of beverage chosen. There are other automatic dispensing machines that utilize variously sized cups according to the beverage chosen but limited to large or medium sizes, but not as small as those usually used for espresso-type coffee. EP 1818881 discloses an automatic dispensing machine that provides a large or medium sized cup corresponding to the selected beverage. In such a vending machine the cup is delivered by dispensing towers through a dispensing cone that connects the exit paths of the cup dispensing towers. Once delivered, the cup is stopped in place upon a support placed towards the user and filled with the chosen beverage through a nozzle that is in a raised position with respect to the edge of the cup.

GB 1604306 discloses an automatic dispensing machine for beverages that is provided with two dispensing towers, in which variously sized cups can be used. The cup holder device is connected to a shaft by a system of cams and springs that allows movement towards either of the cup dispensing towers and the relative positioning of the holder device in correspondence to the exit paths of the cup dispenser. The shaft moves only in an orthogonal direction to the axis connecting the centers of the cup dispensing towers and the holding device can move only at a small angle, right and left in relation to the user, in the direction of the exit-paths of the cup dispensing of the two cup dispensing towers. This device does not allow calibration of the system in such a way to easily fill large, medium and also small sized cups. Moreover, the presence of cams and springs makes the device subject to wear and maintenance problems due to inevitable and frequent cleaning and disinfection of the dispensing machines.

As previously described, one of the main disadvantages of such known machines is that the applied configurations and operating systems do not allow the use of small sized cups, in addition to large and medium cups, in a single machine. The small sized cups, for example those used for espresso-type coffee, generally have a height and a diameter smaller than 60 mm. These cups require, besides supports adapted to receive such small cups, specifically sized nozzles arranged in the vicinity of the edge, or better, within the cups to ensure that sugar, a stir stick and coffee are dispensed properly into the cup. The automatic beverage dispensing machines of the prior art generally have a mounted nozzle system for dispensing various beverages, a sugar dispenser and a stir stick dispenser, each having a single product dispenser exit which appears to be well proportioned, if compared to the size of large and medium sized cups but not to smaller sized cups, such as espresso-type coffee cups. In the latter case it is necessary that the cup be positioned below and very close to the various dispensers so that the various products can be correctly served.

SUMMARY OF THE INVENTION

There is provided in accordance with the present invention an automatic machine for dispensing beverages and a process to provide the dispensing of beverages into differently sized cups, especially the cups with a diameter less than 60 mm such as those used for espresso-type coffee.

There is further provided in accordance with the present invention an automatic machine for dispensing beverages and a process that allows the machine to provide two different beverages in a space as small as possible.

There is further provided in accordance with the present invention an automatic machine for dispensing beverages and a process that is able to guarantee perfect dispensing of espresso-type coffee in small sized cups without splashing or spillage of the product.

There is further provided in accordance with the present invention an automatic machine for dispensing beverages and a process which are able to guarantee a high quality level of the beverages provided.

There is further provided in accordance with the present invention an automatic machine for dispensing beverages that reduces maintenance time and that allows a simple and efficient replacement and cleaning of the cup holder device when needed.

According to the present invention an automatic machine for dispensing beverages has at least two rotatable cup dispensing towers each having a plurality of housings for variously sized stacked cups. The cup dispensing towers may be rotated in a selective manner about vertical axes. Cups are dispensed from the housings. A cup holder device includes cup holders that receive the dispensed cups. The cup holder device is rotatable about a vertical axis that is parallel to the axes of rotation of the rotatable cup dispensing towers. The cup holders of the cup holder device move along concentric circular trajectories with respect to the vertical axis of the cup holder device.

According to another aspect of the present invention a process for dispensing a beverage from an automatic machine of the type described in the immediately preceding paragraph comprises the steps of:

(a) supplying a cup exiting from one of the two cup dispensing towers to a cup holder of the cup holder device with the cup holder in a starting position;

(b) rotating the cup holder device until the cup reaches a dispensing position for sugar or other items such as stir sticks;

(c) dispensing of items other than a beverage such as sugar and/or a stir-stick if requested by a user;

(d) rotating the cup holder device until the cup is aligned with a beverage dispensing nozzle;

(e) dispensing a beverage into the cup;

(f) rotating the cup holder device until the cup is presented to the user and the machine is inactivated; and (g) only after the user removes the cup containing the beverage from the machine and the machine is reactivated rotating the cup holder device until the cup holder returns to the starting position.

BRIEF DESCRIPTION OF THE DRAWINGS

More features and advantages of the present invention will be made clear by the following description, exemplifying but not limiting in reference to the attached drawings.

DETAILED DESCRIPTION OF THE INVENTION

Figure 1:
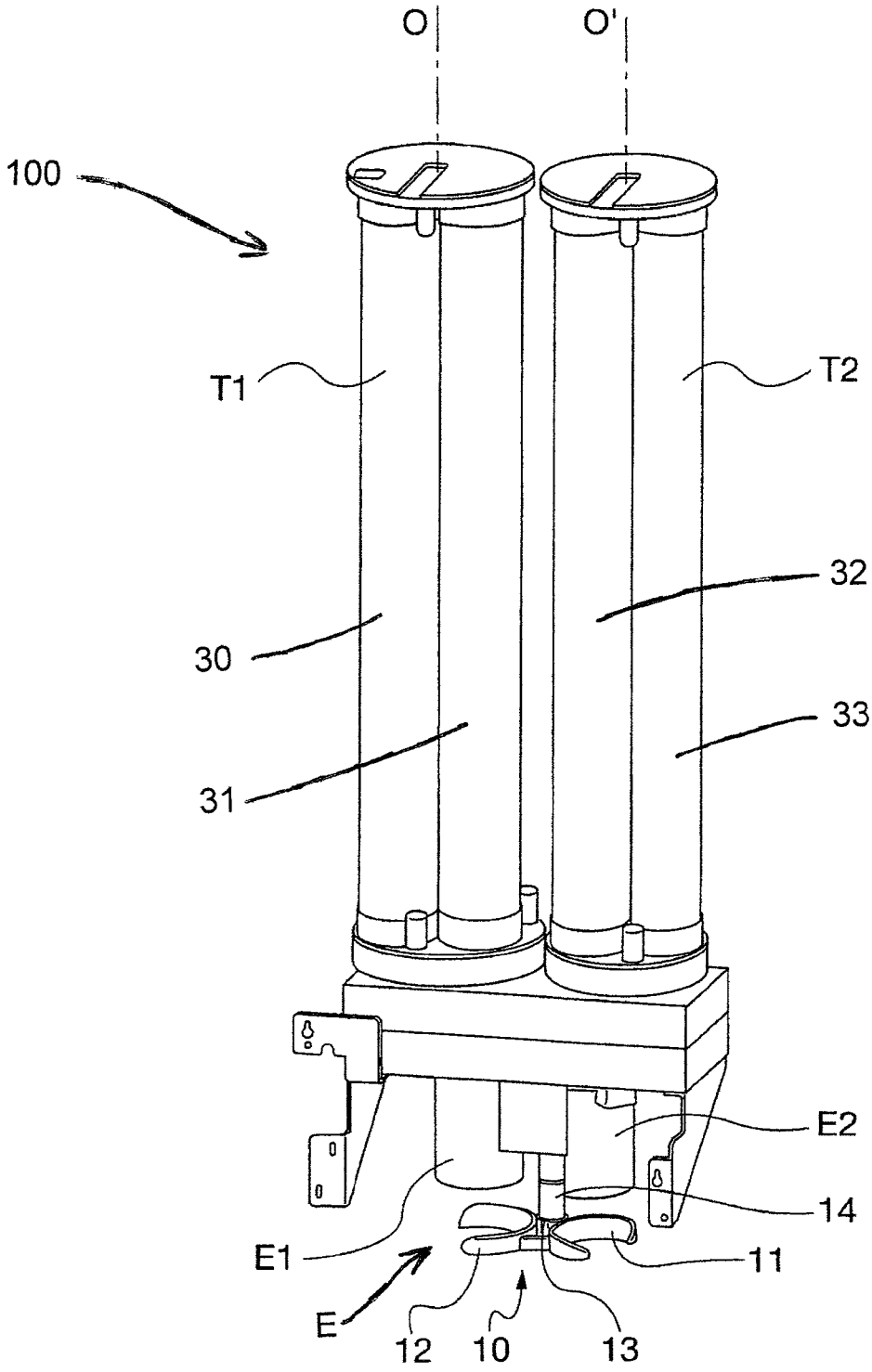
FIG. 1 is a perspective view of an assembly of cup dispensing towers and a cup holder device of a machine according to the present invention.
Figure 2:
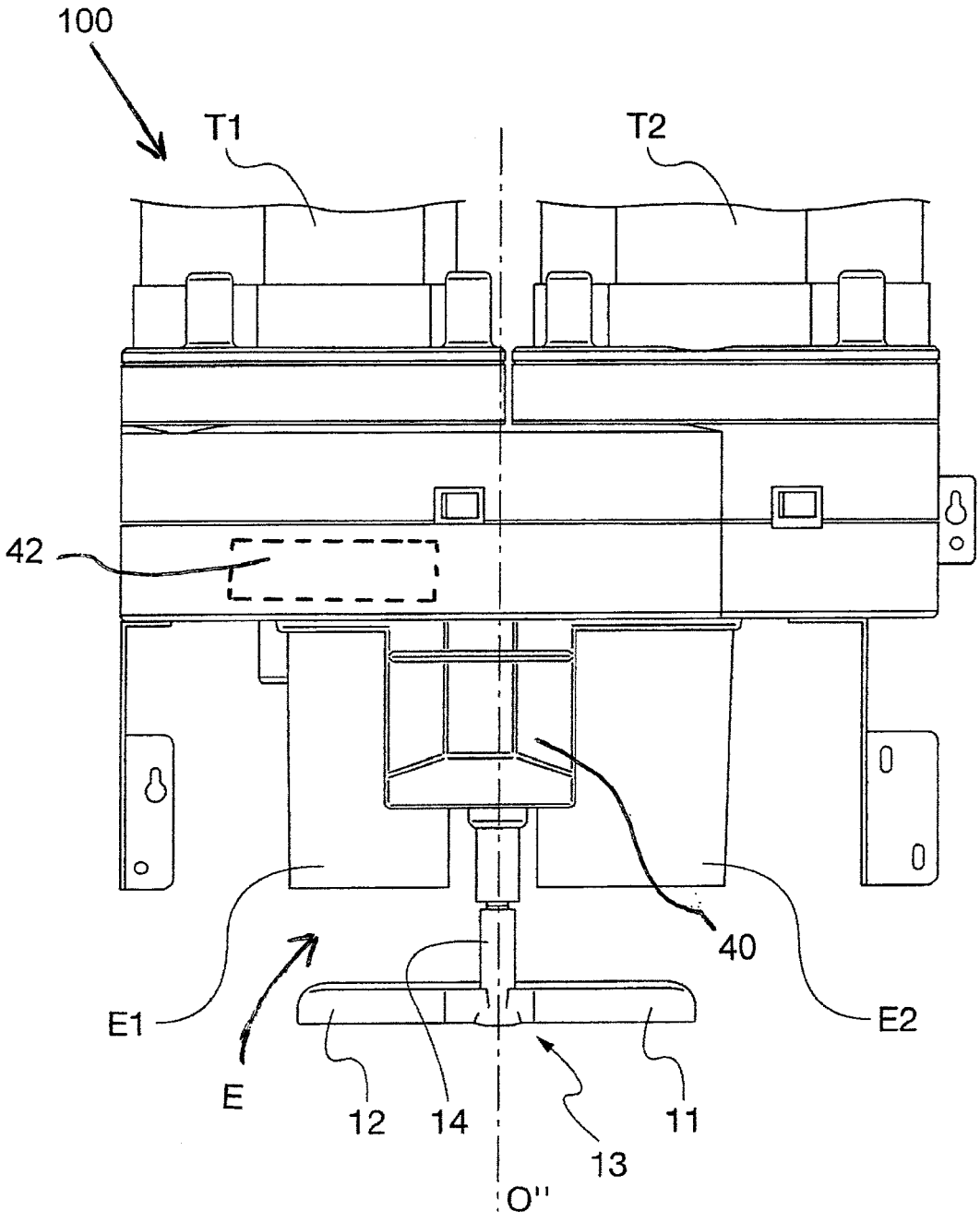
FIG. 2 is a front view of a lower portion of the assembly of cup dispensing towers and a cup holder device of FIG. 1.
Figure 3:
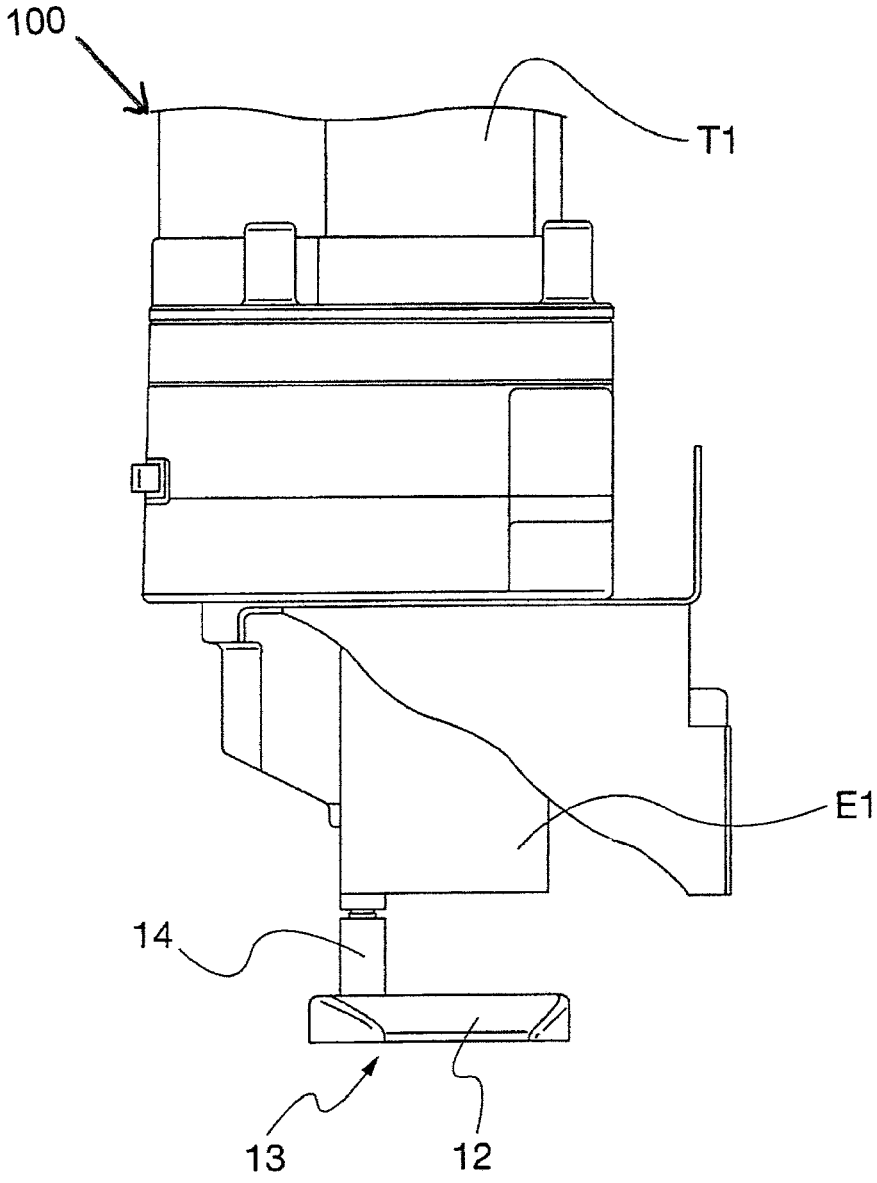
FIG. 3 is a side view of a lower portion of the assembly of cup dispensing towers and a cup holder device of FIG. 1.

FIGS. 1-3 show an automatic machine 100 for dispensing beverages. According to an exemplary embodiment of the invention the machine includes an assembly of cup dispensing towers T1, T2 each having a plurality of housings for variously sized stacked cups and a cup holder device 10. The machine comprises two cup dispensing towers T1, T2 each having a plurality of housings 30, 31; 32, 33 in which variously sized beverage cups are stacked. Each of the cup dispensing towers T1, T2 can rotate about its own axis O, O' in order to continuously dispense required cups according to the beverage requested by a person using the machine, also referred to simply as the user. Each cup dispensing tower is filled with variously sized cups. In particular, one cup dispensing tower provides medium/large sized cups and the other cup dispensing tower provides small espresso-type coffee cups. A small cup or small-sized cup means a diameter and height of about 60 mm or less. Small cups normally used for Italian espresso-type coffee have a diameter of 57 mm and a height of 47 mm.

The cup dispensing towers dispense cups by dispensing means E. The dispensing means E comprises two ducts E1 and E2 having two cup dispensing openings A1, A2 that are best shown in FIGS. 4-7. The cup dispensing towers T1, T2, one with medium or large sized cups and the other with small stacked cups, rotate around their own axes O, O' to ensure that the stacks of cups of the two available sizes are aligned with the cup dispensing openings A1, A2.

The cup dispensing towers T1, T2, respectively one with small cups and the other with medium or large stacked cups, each rotate about its own axis O, O' in such a way as to always allow that there are cups in aligned with the associated cup dispensing opening A1, A2. Once the user has chosen a beverage, a cup corresponding to the chosen beverage, namely a small espresso-type coffee cup or a medium/large cup for other beverages, is dispensed from one of the two cup dispensing towers T1, T2 and stopped at the exit of the openings A1, A2 by a cup holder device 13 positioned below the dispensing openings A1, A2. The cup holder device 13 is placed between the two cup dispensing towers, preferably at the center, and is preferably equipped with two cup holders 11, 12. In particular the cup holders are arcuate housings similar to two pronged forks 11, 12 each able to support one cup having exterior dimensions that are complementary to an interior dimension of the cup holder. The descent of a dispensed cup is stopped by a cup of holder placed below the dispensing opening. In particular one cup holder is dimensioned to stop the descent of a medium or large sized cup from a cup dispensing opening A1, A2 and the other cup holder is dimensioned to stop the descent of a small sized cup from a cup dispensing opening A1, A2.

The cup holder device 13 is equipped with a shaft 14 oriented orthogonal to the plane of the cup holders. The shaft is placed between the two cup dispensing towers, preferably at the center. The shaft 14 is driven by a motor 40 that allows the rotation of the cup holder device by 360 degrees about its own axis O" which is parallel to the axes of rotation O, O' of the cup dispensing towers T1, T2.

As best shown in FIGS. 4-7 in this exemplary machine each of the cup holders 11, 12 of the cup holder device 13 comprises an arcuate housing with the arc having a center. The cup holders 11, 12 are fixed to the shaft 14 of the cup holder device such that radii of the two cup holders intersect one another and the axis of rotation O" of the shaft at an included angle in a range between 90 and 180 degrees. Preferably radii of the two cup holders intersect one another and the axis of rotation of the shaft at an included angle of about 120 degrees. The angle between the two cup holders 11, 12 is dimensioned is such as to minimize space and maintain the cup holders are dimensioned to support variously sized cups as closely as possible. As shown in the exemplary embodiment of the drawings the arcuate housings of the cup holders 11, 12 are joined to the shaft 14 of the cup holder device by connecting arms 35, 36. Furthermore, the centers of the arcuate housings of the cup holder 11, 12 move along concentric circular paths as the shaft 14 of the cup holder device 13 is rotated by a motor 40 about the axis of rotation O" of the shaft of the cup holder device.

Figure 4:
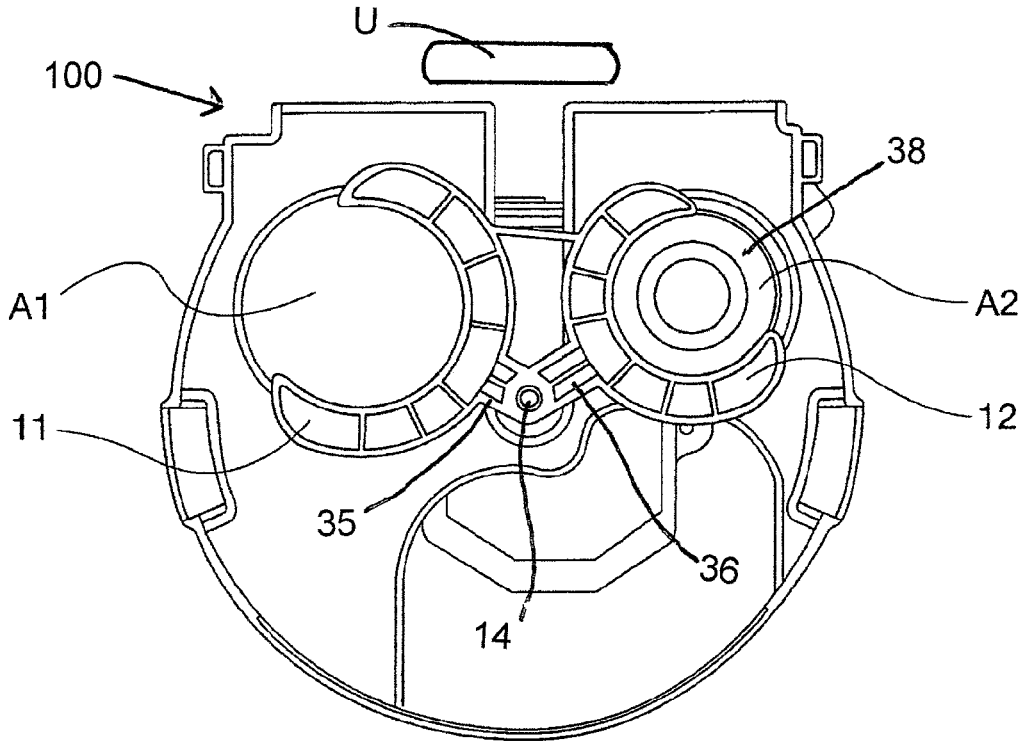
FIGS. 4-7 are bottom views of assembly of cup dispensing towers and a cup holder device of FIG. 1 in which are illustrated the positions occupied by the cup holder device during the steps of cup dispensing, stir-stick and sugar dispensing, beverage dispensing and presentation to a user of the machine.

FIGS. 4-7 are bottom views of assembly of cup dispensing towers and a cup holder device of FIG. 1. The location of a user of the machine during the operation of the machine is schematically represented at U in FIG. 4. FIGS. 4-7 show the positions of the cup holder device 13 during cup dispensing, beverage dispensing and dispensing of any additional items arranged along a circular trajectory and the positions occupied by the cup holder device 13, and therefore by the cup holders 11, 12, in relation to the user. When the machine is switched on or activated, the shaft of the 14 cup holder device 13 is rotated about its axis O" along with the cup holders 11, 12 in the direction of the cup dispensing openings A1, A2. Preferably the two cup dispensing openings A1, A2 are aligned with the positions of the two cup holders as shown in FIG. 4. According to the user's choice, a medium/large cup is loaded onto the larger cup holder 11 or a small cup 38 is loaded onto the smaller cup holder 12.

According to the process of the exemplary embodiment of the invention the cup 38 is moved by the machine along at least part of a circumference, preferably upon a series of circumference arches. In particular, in the shown embodiment, the cup 38 placed on one of the smaller of the two cup holders 12 moves along a circular trajectory with respect to the vertical axis of rotation O" of the shaft 14 of the cup holder device, stopping in the various dispensing positions of the various items. The movement of the cup holders 11, 12 along this circular trajectory is shown in this example as being in a counterclockwise direction in relation to the user U.

Figure 5:
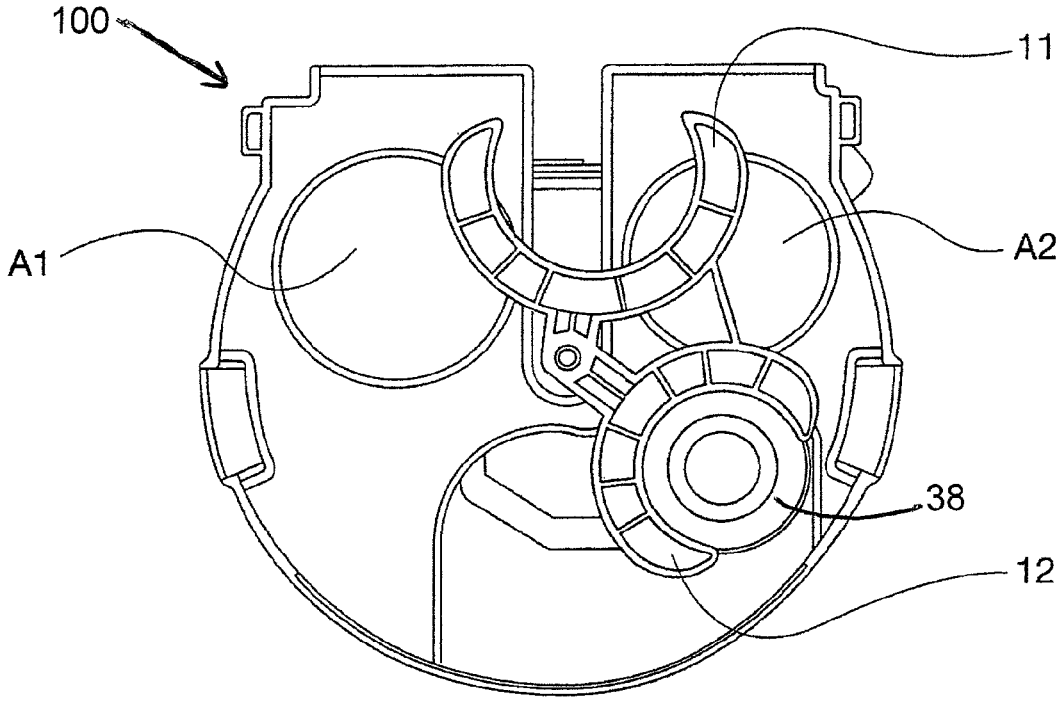

As shown in FIG. 5 the first position to which the cup 38 supported by a cup holder is moved by rotation of the shaft of the cup holding device is to a position for dispensing an item other than the beverage, such a sugar and/or a stir stick. Then if requested by a user of the machine the item or items requested are dispensed into the cup.

Figure 6:
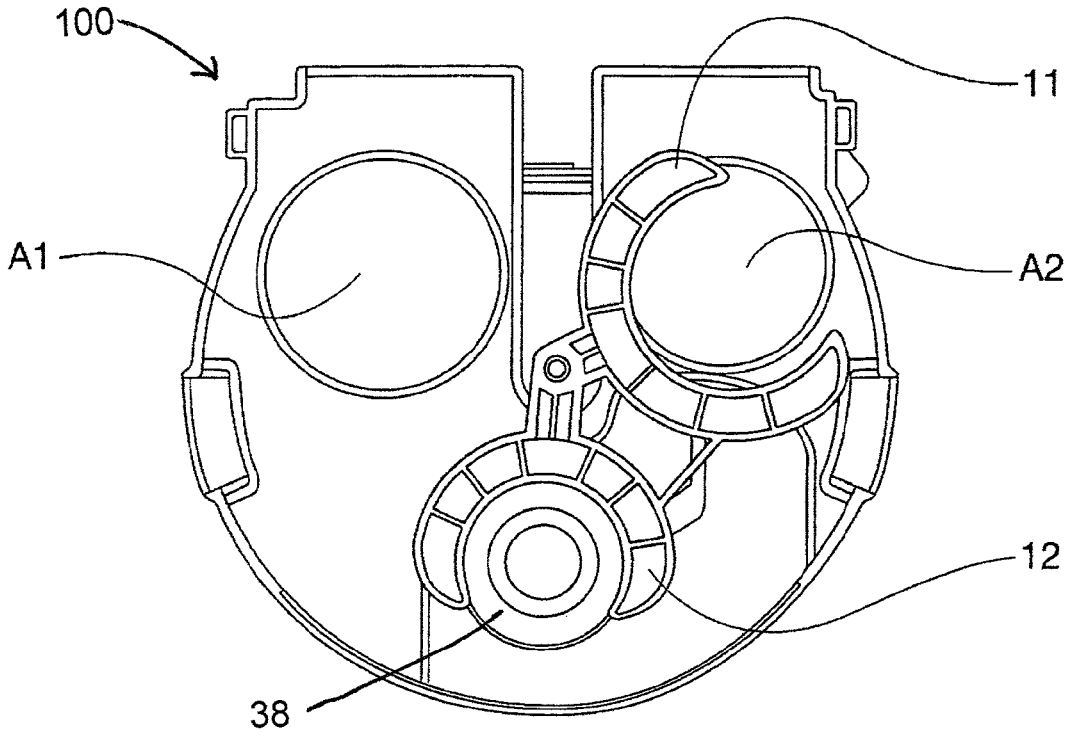

As shown in FIG. 6 the second position to which the cup 38 supported by a cup holder is moved by rotation of the shaft of the cup holding device to a position for dispensing the beverage where the beverage dispensing nozzle system is situated. This system combines the exit ducts of the various beverages and is positioned in relation to the cup in such a way as to perfectly dispense the beverage within the cup avoiding possible splashing.

Figure 7:
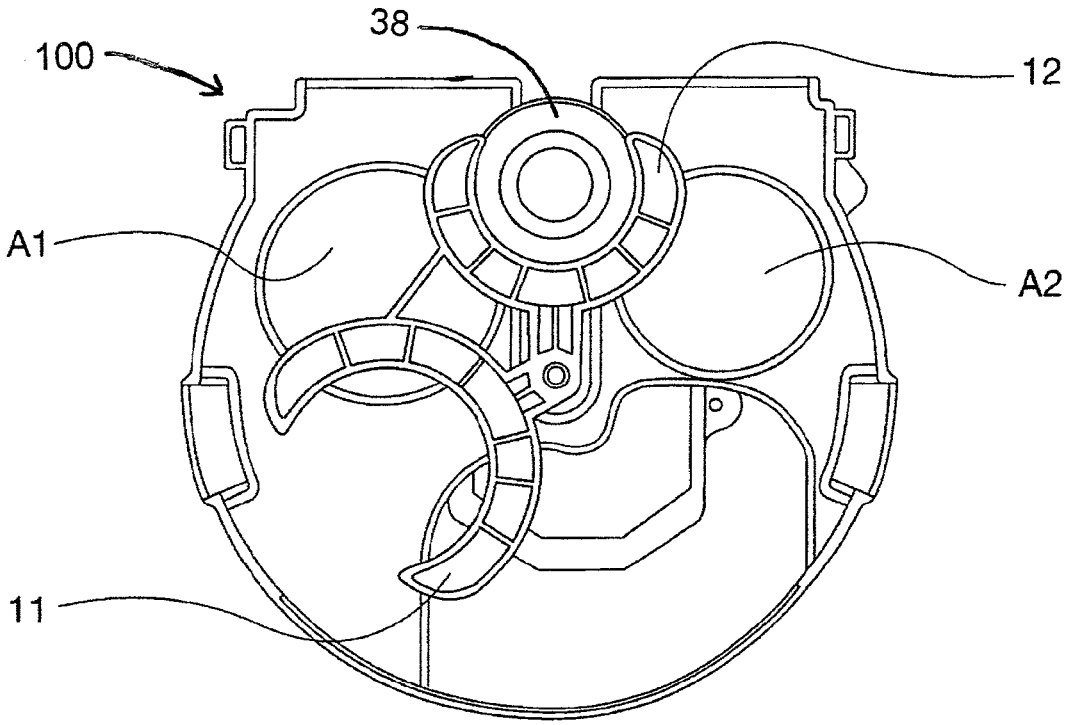

As shown in FIG. 7 after the beverage has been dispensed, the cup 38 supported by the cup holder 11, 12 is moved by rotation of the shaft of the cup holding device moves along the circular trajectory to be positioned in front of the user presenting the ready beverage and remaining there until a new beverage is requested. To ensure that the user withdraws the ready beverage in time, the cup holder 11, 12 stops in the position of beverage presentation until the cup is withdrawn and another beverage is requested. Once the beverage is withdrawn, the cup holder device 13 is moved by rotation of the shaft of the cup holding device to the initial position, bringing back the two cup holders 11, 12 in correspondence to the cup dispensing openings A1, A2 only when another beverage is requested or when the machine is turned off and then turned on once again.

All positions occupied by the cup holders 11, 12 so far described are distributed along an ideal circumference having as a center the axis of rotation O" of the cup holder device 10. Particularly since the cup holder device 13 equipped with two arcuate cup holders 11, 12 with different diameters to receive variously sized cups, the cups will occupy positions placed along concentric circular trajectories according to the size of the cup used.

Preferably a machine according to the invention preferably further comprises a control unit 42 that controls at least the selective rotation of the cup dispensing towers, the rotation of the cup holder device, the movements, timing and for the dispensing of items other than the beverage, the movements and timing for the dispensing of a beverage, as well as the movements and timing for the presentation of the beverage to the user and the return of the cup holder device to the starting position.

While turning on the automatic machine for dispensing beverages 100 the cup holder device 13 positions itself with the cup holders 11, 12 aligned with the cup dispensing openings A1, A2. According to the user's choice a medium/large cup is loaded on the larger cup holder 11 or a small cup is loaded on the smaller cup holder 12. The cup 38 placed on one of the two cup holders will move along a circular path with respect to the vertical axis of rotation O" of the shaft 14 of the cup holder device and stopping at the different dispensing stations of the various products. As shown in the drawings of the exemplary machine the displacement along this circle path is counterclockwise in relation to the user U. After the possible dispensing of items other than a beverage, such as sugar and stir-stick if requested by the user, the cup holder 12 with the cup 38 moves in a counterclockwise direction until reaching the position of dispensing of the beverage in which the nozzle system is placed, sized and positioned so to perfectly dispense the beverage into the cup avoiding possible splashing.

Once the beverage has been dispensed, the cup 38 supported by the cup holder 12 moves counterclockwise along the above mentioned circular path until it is in front of the user U to present the ready beverage remaining in place until a new beverage is requested. The cup holder with the cup and the ready beverage stops in this position and does not return to the starting position of cup dispensing so as to allow the user to remove the beverage without haste. Once the beverage has been removed by the user, the cup holder device moves counterclockwise to the initial position after another beverage is requested, thus repositioning the two cup holder at the corresponding cup dispensing openings of the cup dispensing towers.

All positions in which the dispensed cups are located during the various operation steps of the machine are distributed along an ideal circumference having as a center the rotational axis O" of the shaft 14 of the cup holder device. Since the cup-holder device 13 is equipped with at least two cup holders 11, 12 of different diameters to receive cups of different sizes, the cups will occupy positions placed along concentric circular trajectories according to the size of the cup used.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What is claimed is:

1. An automatic machine for dispensing of beverages comprising at least two rotatable cup dispensing towers, each cup dispensing tower having a vertical axis of rotation and a plurality of housings for variously sized stacked cups, the housings of one of the cup dispensing towers containing cups that are of a different size from the cups contained in the housings of the other dispensing tower, means for selective rotation of the housings, means for dispensing cups from the cup dispensing towers, at least one cup holder device comprising a shaft that is connected to and oriented orthogonal to at least two cup holders of different sizes for receiving cups of different sizes, the shaft driven by a motor and having a vertical axis that is an axis of rotation of the cup holder device and is parallel to the axes of rotation of the cup dispensing towers, and rotation of the cup holder device causes the cup holders to move along concentric circular trajectories with respect to the vertical axis of rotation of the cup holder device.

2. The automatic machine for dispensing of beverages according to claim 1 wherein: a position of a cup holder of the cup holder device that receives a cup during cup dispensing, a position of the cup holder that contains the cup during the dispensing of a beverage, a position of the cup holder that contains the cup during the dispensing of any other items, and a position of the cup holder that contains the cup during presentation of the cup to a user of the machine are arranged along the circular trajectory.

3. The automatic machine for dispensing of beverages according to claim 1 wherein each of the cup holders of the cup holder device comprises an arcuate housing with the arc having a center, the cup holders being fixed to the shaft of the cup holder device such that radii of the two cup holders intersect one another and the axis of rotation of the shaft at an included angle in a range between 90 and 180 degrees.

4. The automatic machine for dispensing of beverages according to claim 3 wherein radii of the two cup holders intersect one another and the axis of rotation of the shaft at an included angle of about 120 degrees.

5. The automatic machine for dispensing of beverages according to claim 3 wherein radii of the two cup holders intersect one another and the axis of rotation of the shaft at an included angle such that both of the cup holders can be positioned at the same time in correspondence to relative cup dispensing means.

6. A process for dispensing a beverage prepared by the automatic machine for dispensing beverages of claim 1 wherein the automated machine further comprises a plurality of dispensing stations and a cup dispensed from the means for dispensing cups from the cup dispensing towers is received in one of the cup holders and rotation of the cup holder device causes the cup to be moved between the dispensing stations of the machine when the cup holders of the cup holder device move along concentric circular trajectories with respect to the vertical axis of the cup holder device.

7. The process according to claim 6 comprising the steps of:

(a) dispensing a cup that is exiting out of one of the two cup dispensing towers and is received by one of the cup holders;

(b) rotating the cup holder device until the cup reaches a dispensing station for sugar when requested by the user;

(c) dispensing of sugar and stir-stick only when requested by a user of the machine;

(d) rotating the cup holder device until the cup reaches a position which is aligned with a beverage dispensing nozzle;

(e) dispensing a beverage into the cup;

(f) rotating the cup holder device until the cup reaches a position for presentation of cup containing the beverage to the user of the machine; and (g) rotating the cup holder device until the cup holders are positioned to receive a cup that is exiting out of one of the two towers only when the machine is turned off and started once again.

8. The automatic machine for dispensing beverages according to claim 4 wherein radii of the two cup holders intersect one another and the axis of rotation of the shaft at an included angle such that both of the cup holders can be positioned at the same time in correspondence to relative cup dispensing means.

9. A process for dispensing a beverage prepared by an automatic machine comprising the steps of:

(a) providing an automatic machine for dispensing beverages that comprises at least two rotatable cup dispensing towers each having at least one housing for variously sized stacked cups, the housing of each cup dispensing tower containing cups of a different size than the housing of the other cup dispensing tower, each cup dispensing tower having a means for dispensing cups from the cup dispensing tower, a cup holder device having cup holders of different sizes for receiving the dispensed cups, the machine having dispensing stations and the cup holder containing a cup being movable between the dispensing stations of the machine via a path that is at least partly circular;

(b) with the cup holder device in a starting position dispensing a cup exiting out of one of the cup dispensing towers and receiving the cup in a cup holder of the cup holder device;

(c) rotating the cup holder device until the cup reaches a position for dispensing an item other than the beverage;

(d) dispensing at least one item other than the beverage into the cup if requested by a user of the machine;

(e) rotating the cup holder device until the cup reaches a position aligned with a beverage dispensing nozzle;

(f) dispensing the beverage into the cup;

(g) rotating the cup holder device until the cup containing the beverage is in a presentation position where the cup is placed in front of the user of the machine; and (h) rotating the cup holder device until returning to the starting position only when the machine has been turned off and started once again.

10. The process according to claim 9 in which the cup holder device is rotatable about a vertical axis parallel to the axis of rotation of the cup dispensing towers provided with at least two cup holders that move along concentric circular trajectories with respect to the vertical axis.

11. The process according to claim 9 in which the cup holder device rotates between a first position that is the starting position, a second position that includes step (d), a third position that includes step (f), and a fourth position which is the presentation position where the cup is placed in front of the user of the machine.

12. The process according claim 10 in which the cup holder device rotates between a first position that is the starting position, a second position that includes step (d), a third position that includes step (f), and a fourth position which is the presentation position where the cup is placed in front of the user of the machine.

13. The process according to claim 11 in which the cup holder device is located in the first position during step (b).

14. The process according to claim 11 in which the cup holder device moves to the starting position during step (h) to bring the cup holders of the cup holder device into alignment with the means for dispensing cups from the cup dispensing tower.

15. The process according to claim 9 in which the machine further comprises a control unit that controls at least the selective rotation of the cup dispensing towers, the rotation of the cup holder device, the movements and timing for the dispensing of items other than the beverage, the movements and timing for the dispensing of a beverage, as well as the movements and timing for the presentation of the beverage to the user and the return of the cup holder device to the starting position.

16. The process according to claim 10 in which the machine further comprises a control unit that controls at least the selective rotation of the cup dispensing towers, the rotation of the cup holder device, the movements and timing for the dispensing of items other than the beverage, the movements and timing for the dispensing of a beverage, as well as the movements and timing for the presentation of the beverage to the user and the return of the cup holder device to the starting position.

* * * * *